US006310023B1

(12) United States Patent
Kornaat et al.

(10) Patent No.: US 6,310,023 B1
(45) Date of Patent: Oct. 30, 2001

(54) MACHINE DISH WASH COMPOSITIONS

(75) Inventors: Wilma Kornaat, Vlaardingen (NL); Deborah Sue Rick, Edgewater, NJ (US); Alan Digby Tomlinson, Vlaardingen (NL)

(73) Assignee: Unilever Home & Personal Care USA, division of Conopco, Greenwich, CT (US)

( * ) Notice: Subject to any disclaimer, the term of this patent is extended or adjusted under 35 U.S.C. 154(b) by 0 days.

(21) Appl. No.: 09/709,174

(22) Filed: Nov. 9, 2000

(30) Foreign Application Priority Data

Nov. 12, 1999 (EP) ..... 99309033

(51) Int. Cl.[7] ..... C11D 3/10; C11D 3/36

(52) U.S. Cl. ..... 510/223; 510/224; 510/229; 510/467; 510/477; 510/478; 510/488

(58) Field of Search ..... 510/223, 224, 510/229, 477, 478, 467, 488

(56) References Cited

U.S. PATENT DOCUMENTS 6,172,028 * 1/2001 Baur et al. ..... 510/361

6,239,091 * 5/2001 Tartakovsky et al. ..... 510/220

FOREIGN PATENT DOCUMENTS

364067 * 4/1990 (EP) .

* cited by examiner

*Primary Examiner*—Gregory Delcotto

(57) ABSTRACT

A detergent composition comprising sodium citrate and an organo monophosphonic acid or a salt thereof of formula I formula I

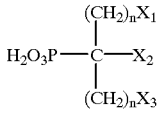

where n is an integer from 0 to 6 and $X_1$, $X_2$, $X_3$ are independently selected from an alkyl, alkenyl, aryl or carboxy group with the proviso that at least one of $X_1$, $X_2$, $X_3$ is a carboxy group.

4 Claims, No Drawings

MACHINE DISH WASH COMPOSITIONS

TECHNICAL FIELD

The present invention is in the field of machine dishwashing. More specifically, the invention encompasses automatic dishwashing compositions.

BACKGROUND OF THE INVENTION

A common problem with detergent compositions for use in automatic dish washing machines is that they cause spotting and filming on crockery and glasses during the wash process. The spotting and filming is caused by the deposition of calcium salts.

The spotting and filming is a particular problem when a non-phosphate detergent is used. EP 0 659 874 (Procter and Gamble) recognises this problem and describes a carboxylate based builder system with ethyl 1-hydroxy-1,1 phosohonic acid and an organic polymer.

EP 0 364 067 (The Clorox Company) describes a machine dishwashing composition with alkali metal carbonate as the sole builder, an alkali metal silicate, a low foaming surfactant and a calcium crystal growth inhibitor which may be a phosphonic acid.

The present invention has found that the precipitation of calcium can be mitigated by the choice of chelating agent and builder.

Furthermore, compositions according to the present invention are particularly stable.

DESCRIPTION OF THE INVENTION

Accordingly, the present invention provides a detergent composition comprising sodium citrate and an organo monophosphonic acid or a salt thereof.

DETAILED DESCRIPTION OF THE INVENTION

Organo Monophosphonic Acids and Salts

The invention has an essential feature an organo mono phosphonic acid or a salt thereof having the following formula:

formula I

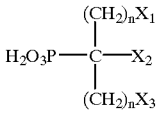

where n is an integer from 0 to 6 and $X_1$, $X_2$, $X_3$ are independently selected from an alkyl, alkenyl, aryl or carboxy group with the proviso that at least one of $X_1$, $X_2$, $X_3$ is a carboxy group.

Preferably, the organo monophosphonic acid has the structure

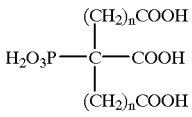

where n is an integer from 0 to 5.

More preferably, the organo monophosphonic acid is 2 phosphono-butane 1,2,4 tricarboxylic acid.

It is preferable if the level of organo monophosphonic acids is from 0.1 to 5 wt %, more preferably 0.5 to 3 wt %, most preferably 0.5 to 2 wt. % of the total composition.

Builder Material

The compositions of the invention comprise as a water-soluble acid builder sodium citrate.

It is preferable if sodium citrate is present at a level of at least 15 wt % of the total formulation, more preferably at a level greater than 20 wt %, most preferably at a level greater than 30 Wt %. a level greater than 20 wt %, most preferably at a level greater than 30 Wt %.

It is desirable if a second builder is present. Preferred builders include sodium carbonate (with or without calcite seeds), potassium carbonate, sodium and potassium bicarbonates. Sodium and potassium bicarbonates are especially preferred, most especially sodium bicarbonate.

It is preferred if the weight ratio of citrate builder to builder is at least 1:1, preferably between 1:1 and 4:3.

Further soluble detergency builder salts that can be used with the present invention are poly-valent inorganic and poly-valent organic builders or mixtures thereof. Non-limiting examples of suitable water-soluble, inorganic alkaline detergency builder salts include borates, phosphates, polyphosphates, and tripolyphosphates. Specific examples of such salts include the sodium and potassium tetraborates, tripolyphosphates, orthophosphates and hexametaphosphates. However it is preferable if the detergent formulation is free or only has low levels (5% or less) of builder salts which precipitate during the wash in the presence of calcium.

Other additional detergency builders include organic alkaline compounds such as water-soluble amino polyacetates, e.g. sodium and potassium ethylenediamine tetraacetates, nitrilotriacetates and N-(2-hydroxyethyl) nitrilodiacetates; water-soluble salts of phytic acid, e.g. sodium and potassium phytates; water-soluble polyphosphonates, including sodium, potassium and lithium salts of ethane-1-hydroxy-1,1-diphosphonic acid; sodium, potassium and lithium salts of methylenediphosphonic acid and the like.

It is to be understood that, while the alkali metal salts of the foregoing inorganic and organic poly-valent anionic builder salts are preferred for use herein from an economic standpoint, the ammonium, alkanolammonium, e.g. triethanol-ammonium, diethanolammonium, and the like, water-soluble salts of any of the foregoing builder anions are useful herein.

Preferred builders for use in the invention are sodium citrate and sodium bicarbonate and mixtures thereof. Alternatively, the potassium salts of these acids may be used.

Preferably, the amount of total builders in the composition is from 30 to 80% by weight, more preferably from 40 to 70% by weight.

Silica Material

Suitable forms of silica include amorphous silica, such as precipitated silica, pyrogenic silica and silica gels, such as hydrogels, xerogels and aerogels, or the pure crystal forms quartz, tridymite or crystobalite, but the amorphous forms of silica are preferred. Suitable silicas may readily be obtained commercially. They are sold, for example under the Registered Trade Name Gasil 200 (ex Crosfield, UK).

Preferably, the silica is in the product in such a form that it can dissolve when added to the wash liquor. Therefore, addition of silica by way of addition anti-foam particles of silica and silicone oil is not preferred.

The particle size of the silica material of the present invention may be of importance, especially as it is believed that any silica material that remains undissolved during the washing process, may deposit on the glass at a later stage. Therefore, it is preferred that silica material are used that have a particle size (as determined with a Malvern Laser, i.e.

"aggregated" particles size) of at most 40 μm, more preferably at most 30 μm, most preferably at most 20 μm provides better results in the wash. In view of incorporation in a cleaning composition, it is preferred that the particle size of the silica material is at least 1 μm, more preferably at least 2 μm, most preferably at least 5 μm.

Preferably the primarily particle size of the silica is in general less than about 30 nm, in particular less than about 25 nm. Preferably, elementary particles sizes are less than 20 nm or even 10 nm. There is no critical lower limit of the elementary particle size; the lower limit is governed by other factors such as the manner of manufacture, etc. In general, commercial available silicas have elementary particle sizes of 1 nm or more.

Preferably, the silica material is present in the wash liquor at a level of at least $2.5\times10^{-4}$%, more preferably at least $12.5\times10^{-4}$%, most preferably at least $2.5\times10^{-3}$% by weight of the wash liquor and preferably at most $1\times10^{-1}$%, more preferably at most $8\times10^{-2}$%, most preferably at most $5\times10^{-2}$% by weight of the wash liquor.

Preferably, the level of dissolved silica material in the wash liquor is at least 80 ppm, more preferably at least 100 ppm, most preferably at least 120 ppm and preferably at most 1,000 ppm. It is noted that for the silica material to be effective, the lower level of dissolved silica material depends on the pH value, i.e. thus at pH 6.5, the level is preferably at least 100 ppm; at pH 7.0 preferably at least 110 ppm; at pH 7.5 preferably at least 120 ppm; at pH 9.5 preferably at least 200 ppm; at pH 10 preferably at least 300 ppm; at pH 10.5 preferably at least 400 ppm.

Preferably, the silica material is present in the cleaning composition at a level of at least 0.1%, more preferably at least 0.5%, most preferably at least 1% by weight of the cleaning composition and preferably at most 10%, more preferably at most 8%, most preferably at most 5% by weight of the cleaning composition.

Silicates

The composition optionally comprises alkali metal silicates. The alkali metal may provide pH adjusting capability and protection against corrosion of metals and against attack on dishware, including fine china and glassware benefits. When silicates are present, the $SiO_2$ level should be from 1% to 25%, preferably from 2% to 20%, more preferably from 3% to 10%, based on the weight of the ADD. The ratio of $SiO_2$ to the alkali metal oxide ($M_2O$, where M=alkali metal) is typically from 1 to 3.5, preferably from 1.6 to 3, more preferably from 2 to 2.8. Preferably, the alkali metal silicate is hydrous, having from 15% to 25% water, more preferably, from 17% to 20%.

The highly alkali metasilicates can in general be employed, although the less alkaline hydrous alkali metal silicates having a $SiO_2$:$M_2O$ ratio of from 2.0 to 2.4 are, as noted, greatly preferred. Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium, potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles having a mean particle size between 300 and 900 microns and less than 40% smaller than 150 microns and less than 5% larger than 1700 microns. Particularly preferred is a silicate particle with a mean particle size between 400 and 700 microns with less than 20% smaller than 150 microns and less than 1% larger then 1700 microns. Compositions of the present invention having a pH of 9 or less preferably will be substantially free of alkali metal silicate.

Enzymes

Enzymes may be present in the compositions of the invention. Examples of enzymes suitable for use in the cleaning compositions of this invention include lipases, peptidases, amylases (amylolytic enzymes) and others which degrade, alter or facilitate the degradation or alteration of biochemical soils and stains encountered in cleansing situations so as to remove more easily the soil or stain from the object being washed to make the soil or stain more removable in a subsequent cleansing step. Both degradation and alteration can improve soil removal.

Well-known and preferred examples of these enzymes are lipases, amylases and proteases. The enzymes most commonly used in machine dishwashing compositions are amylolytic enzymes. Preferably, the composition of the invention also contains a proteolytic enzyme. Enzymes may be present in a weight percentage amount of from 0.2 to 10% by weight.

Bleach Material

Bleach material may optionally and preferably be incorporated in composition for use in processes according to the present invention. These materials may be incorporated in solid form or in the form of encapsulates and less preferably in dissolved form.

The bleach material may be a chlorine- or bromine-releasing agent or a peroxygen compound. Peroxygen based bleach materials are however preferred.

Organic peroxy acids or the precursors therefor are typically utilised as the bleach material. The peroxyacids usable in the present invention are solid and, preferably, substantially water-insoluble compounds. By "substantially water-insoluble" is meant herein a water-solubility of less than about 1% by weight at ambient temperature. In general, peroxyacids containing at least about 7 carbon atoms are sufficiently insoluble in water for use herein.

Inorganic peroxygen-generating compounds are also typically used as the bleaching material of the present invention. Examples of these materials are salts of monopersulphate, perborate monohydrate, perborate tetrahydrate, and percarbonate.

Monoperoxy acids useful herein include alkyl peroxy acids and aryl peroxyacids such as peroxybenzoic acid and ring-substituted peroxybenzoic acids (e.g. peroxy-alpha-naphthoic acid); aliphatic and substituted aliphatic monoperoxy acids (e.g. peroxylauric acid and peroxystearic acid); and phthaloyl amido peroxy caproic acid (PAP).

Typical diperoxy acids useful herein include alkyl diperoxy acids and aryldiperoxy acids, such as 1,12-di-peroxydodecanedioic acid (DPDA); 1,9-diperoxyazelaic acid, diperoxybrassylic acid, diperoxysebacic acid and diperoxyisophthalic acid; and 2-decyldiperoxybutane-1,4-dioic acid.

Peroxyacid bleach precursors are well known in the art. As non-limiting examples can be named N,N,N',N'-tetraacetyl ethylene diamine (TAED), sodium nonanoyloxybenzene sulphonate (SNOBS), sodium benzoyloxybenzene sulphonate (SBOBS) and the cationic peroxyacid precursor (SPCC) as described in U.S. Pat. No. 4,751,015.

If desirably a bleach catalyst, such as the manganese complex, e.g. Mn-Me TACN, as described in EP-A-0458397, or the sulphonimines of U.S. Pat. No. 5,041,232 and U.S. Pat. No. 5,047,163, is to be incorporated, this may be presented in the form of a second encapsulate separately from the bleach capsule or granule. Cobalt catalysts can also be used.

Among suitable reactive chlorine- or bromine-oxidizing materials are heterocyclic N-bromo and N-chloro imides such as trichloroisocyanuric, tribromoisocyanuric, dibromoisocyanuric and dichloroisocyanuric acids, and salts thereof with water-solubilizing cations such as potassium and sodium. Hydantoin compounds such as 1,3-dichloro-5, 5-dimethyl-hydantoin are also quite suitable.

Particulate, water-soluble anhydrous inorganic salts are likewise suitable for use herein such as lithium, sodium or calcium hypochlorite and hypobromite. Chlorinated trisodium phosphate and chloroisocyanurates are also suitable bleaching materials.

Encapsulation techniques are known for both peroxygen and chlorine bleaches, e.g. as described in U.S. Pat. No. 4,126,573, U.S. Pat. No. 4,327,151, U.S. Pat. No. 3,983,254, U.S. Pat. No. 4,279,764, U.S. Pat. No. 3,036,013 and EP-A-0,436,971 and EP-A-0,510,761. However, encapsulation techniques are particularly useful when using halogen based bleaching systems.

Chlorine bleaches, the compositions of the invention may comprise from about 0.5% to about 3% avcl (available Chlorine). For peroxygen bleaching agents a suitable range are also from 0.5% to 3% avO (available Oxygen). Preferably, the amount of bleach material in the wash liquor is at least $12.5\times10^{-4}$% and at most 0.03% avO by weight of the liquor.

Surfactant Material

A surfactant system comprising a surfactant selected from nonionic, anionic, cationic, ampholytic and zwitterionic surfactants and mixtures thereof is preferably present in the composition.

Typically the surfactant is a low to non foaming nonionic surfactant, which includes any alkoxylated nonionic surface-active agent wherein the alkoxy moiety is selected from the group consisting of ethylene oxide, propylene oxide and mixtures thereof, is preferably used to improve the detergency without excessive foaming. However, an excessive proportion of nonionic surfactant should be avoided. Normally, an amount of 15% by weight or lower, preferably 10% by weight or lower, more preferably 7% by weight or lower, most preferably 5% by weight or lower. Preferably levels from 0.1% to 3% by weight are present.

Examples of suitable nonionic surfactants for use in the invention are the low- to non-foaming ethoxylated straight-chain alcohols of the Plurafac®. RA series, supplied by the Eurane Company; of the Lutensol® LF series, supplied by the BasF Company and of the Triton® DF series, supplied by the Rohm & Haas Company.

Other surfactants such as anionic surfactant may be used but may require the additional presence of antifoam to surpress foaming. If an anionic surfactant is used it is advantageously present at levels of 2 wt % or below.

Water Soluble Polymeric Polycarboxylic Compounds

A water-soluble polymeric polycarboxylic compound is advantageously present in the dish wash composition. Preferably, these compounds are homo- or co-polymers of polycarboxylic compounds, especially co-polymeric compounds in which the acid monomer comprises two or more carboxyl groups separated by not more than two carbon atoms. Salts of these materials can also be used.

Particularly preferred polymeric polycarboxylates are co-polymers derived from monomers of acrylic acid and maleic acid. The average molecular weight of these polymers in the acid form preferably ranges from 4,000 to 70,000.

Another type of polymeric polycarboxylic compounds suitable for use in the compositions of the invention are homo-polymeric polycarboxylic acid compounds with acrylic acid as the monomeric unit. The average weight of such homo-polymers in the acid form preferably ranges from 1,000 to 100,000 particularly from 3,000 to 10,000.

Acrylic sulphonated polymers as described in EP 851 022 (Unilever) are also suitable.

Preferably, this polymeric material is present at a level of at least 0.1%, more preferably at levels from 1 wt % to 7 wt % of the total composition.

Anti-tarnishing Agents

Anti-tarnishing agents such as benzatriazole and those described in EP 723 577 (Unilever) may also be included.

Optional Ingredients

Optional ingredients are, for example, buffering agents, reducing agents, e.g., borates, alkali metal hydroxide and the well-known enzyme stabilisers such as the polyalcohols, e.g. glycerol and borax; anti-scaling agents; crystal-growth inhibitors, threshold agents; thickening agents; perfumes and dyestuffs and the like.

Reducing agents may e.g. be used to prevent the appearance of an enzyme-deactivating concentration of oxidant bleach compound. Suitable agents include reducing sulphuroxy acids and salts thereof. Most preferred for reasons of availability, low cost, and high performance are the alkali metal and ammonium salts of sulphuroxy acids including ammonium sulphite ($(NH_4)_2SO_3$), sodium sulphite ($Na_2SO_3$), sodium bisulphite ($NaHSO_3$), sodium metabisulphite ($Na_2S_2O_3$), potassium metabisulphite ($K_2S_2O_5$), lithium hydrosulphite ($Li_2S_2O_4$), etc., sodium sulphite being particularly preferred. Another useful reducing agent, though not particularly preferred for reasons of cost, is ascorbic acid. The amount of reducing agents to be used may vary from case to case depending on the type of bleach and the form it is in, but normally a range of about 0.01% to about 1.0% by weight, preferably from about 0.02% to about 0.5% by weight, will be sufficient.

pH of Wash Liquor

The invention relates to washing processes in mechanical dish washing machines wherein the wash liquor has a low pH. By "low pH" is meant here that the pH of the wash liquor is preferably higher than about 6.5, more preferably 7.5 or higher, most preferably 8.5 or higher. Preferably, the pH is lower than about 10.5, more preferably lower than about 10. The most advantageous pH range is from 8.5 to 10.

The invention will now be illustrated by the following non-limiting Examples. Examples of the invention will be illustrated by a number, comparative Examples will be illustrated by a letter.

TABLE 1

| | Examples in parts weight. | | | | | |
|---|---|---|---|---|---|---|
| | A | B | C | D | 1 | 2 |
| Sodium Citrate | 17.25 | 17.25 | 17.25 | 17.25 | 17.25 | 17.25 |
| Sodium disilicate | 9.51 | 9.51 | 9.51 | 9.51 | 9.51 | 9.51 |
| Sodium carbonate | 18.63 | 18.63 | 18.63 | 18.63 | 18.63 | 18.63 |

TABLE 1-continued

| | Examples in parts weight. | | | | | |
|---|---|---|---|---|---|---|
| | A | B | C | D | 1 | 2 |
| Sodium sulphate | 39.89 | 39.89 | 39.89 | 39.89 | 39.89 | 39.89 |
| EHDP[1] | — | 0.70 | — | 0.70 | — | — |
| Sokalan PC 525[2] | — | — | 2.58 | 2.58 | — | 2.58 |
| PBTC[3] | — | — | — | — | 0.70 | 0.70 |

[1]is ethyl hydroxy diphosphonate sodium salt.
[2]is maleic and acrylic acid copolymer MWT 50,000, acrylic acid polymer mwt 4,000.
[3]is 2 phosphono-butane 1,2,4 tricarboxylic acid The Example was added so to make a 1 wt. % solution in water (50°FH/25°FH). The solution was heated to 65° C. for 60 minutes under high agitation/aeration. The pH of the solution was 10.7.

Transmission through the solution was measured in a 1 cm cell using a Novaspec 11 ex Pharmacia Spectrophotometer at 500 nm wavelength.

Transmission is an indirect measure of the precipitation; this is essentially calcium carbonate

TABLE 2

| Product number | % Transmission after 60 mins (500 nm) |
|---|---|
| A | 12 |
| B | 85 |
| C | 19 |
| D | 86 |
| 1 | 96 |
| 2 | 98 |

It is clearly shown that the Example containing PBTC have better transmission through them than the Examples without PBTC.

TABLE 3

| | Examples in equivalent weight | | | | |
|---|---|---|---|---|---|
| | E | F | H | 3 | 4 |
| Sodium Citrate | 30.00 | 30.00 | 30.00 | 30.00 | 30.00 |
| Sodium disilicate | 3.00 | 3.00 | 3.00 | 3.00 | 3.00 |
| Sodium bicarbonate | 25.65 | 25.65 | 25.65 | 25.65 | 25.65 |
| Sodium sulphate | 25.11 | 25.11 | 25.11 | 25.11 | 25.11 |
| EHDP[1] | — | 1.00 | 1.00 | — | — |
| PBTC | — | — | — | 1.00 | 1.00 |
| Sokalan PC 525[2] | — | — | 3.00 | — | 3.00 |

The testing conditions are the same as the previous Examples with the exception that the pH of the 1% solution is 9.5 and the water used is 75°FH/50°FH

TABLE 4

| Product Number | % Transmission after 60 mins (500 nm) |
|---|---|
| E | 40 |
| F | 62 |
| G | 81 |
| 3 | 70 |
| 4 | 99 |

What is claimed is:

1. A detergent composition sodium citrate and 0.5 to 3 wt % of total composition of 2-phosphono-butane-1,2,4-tricarboxylic acid.

2. A detergent composition according to claim 1 wherein the level of sodium citrate is at least 20 wt % of the total formulation.

3. A detergent composition according to claim 1 that further comprises 10 to 35 wt % of carbonate or bicarbonate salt.

4. A detergent composition according claim 1 which further comprises a polymer comprising acetic acid and maleic anhydride.

* * * * *